US005382267A

United States Patent [19]

Savage et al.

[11] Patent Number: 5,382,267

[45] Date of Patent: Jan. 17, 1995

[54] METHOD OF REDUCING INORGANIC AND ORGANIC SULFUR IN SOLID CARBONACEOUS MATERIAL PRIOR TO USE OF THE SOLID CARBONACEOUS MATERIAL

[75] Inventors: Robert L. Savage; Lazarin K. Lazarov, both of Athens, Ohio

[73] Assignee: Ohio University, Athens, Ohio

[21] Appl. No.: 32,879

[22] Filed: Mar. 18, 1993

[51] Int. Cl.[6] ..... C10L 5/00

[52] U.S. Cl. ..... 44/623; 44/624; 44/625

[58] Field of Search ..... 44/623, 624, 625

[56] References Cited

U.S. PATENT DOCUMENTS

| | | | |
|---|---|---|---|
| 3,541,179 | 11/1970 | Okagami et al. | 260/683.3 |
| 3,816,301 | 6/1974 | Sorgenti | 208/208 R |
| 4,441,886 | 4/1984 | Muchmore et al. | 44/15 R |
| 4,491,454 | 1/1985 | Lompa-Krzymien | 44/1 SR |
| 4,797,137 | 1/1989 | Sutton | 44/639 |
| 4,810,362 | 3/1989 | Sutton | 208/246 |
| 4,888,029 | 12/1989 | Shiley et al. | 44/622 |

*Primary Examiner*—John Niebling
*Assistant Examiner*—Edna Wong
*Attorney, Agent, or Firm*—John L. Gray

[57] ABSTRACT

The inorganic and organic desulfurization of solid carbonaceous material at elevated temperatures is increased significantly in the presence of copper. The copper serves as a scavenger for the hydrogen sulfide formed to insure a low hydrogen sulfide concentration for the inorganic desulfurization. In addition, in the presence of ethanol or hydrogen, the organic desulfurization of solid carbonaceous material is improved dramatically by the catalytic influence of the copper on the ethanol dehydrogenization and of the copper sulfide formed on the hydrodesulfurization reactions.

18 Claims, 1 Drawing Sheet

METHOD OF REDUCING INORGANIC AND ORGANIC SULFUR IN SOLID CARBONACEOUS MATERIAL PRIOR TO USE OF THE SOLID CARBONACEOUS MATERIAL

BACKGROUND OF THE INVENTION

There are many references in the literature to the chemical cleaning of solid carbonaceous material. While most of these references are directed to coal, it is to be understood that the term "solid carbonaceous material" includes petroleum coke, metallurgical coke, charcoal, other products of coal pyrolysis, and solid products of coal hydrogenation, as well as coal. The primary objective of these processes is to remove sulphur from the solid carbonaceous material. For the purposes of this patent application the discussion of the prior art and the invention will be described in conjunction with coal but it is to be understood that it is applicable to petroleum coke and charcoal and any other solid carbonaceous materials.

One or more problems associated with the desulfurization of coal based on treatment with gases at elevated temperatures involve the loss of the heating value of the coal, the corrosive reaction conditions required, long reaction times, the need for high temperatures and pressures, the high consumption of hydrogen, waste disposal problems, the relatively small amounts of sulphur removed from the coal, and the inability to market the treated coal.

The use of ethanol to remove sulfur from coal, disclosed in U.S. Pat. No. 4,888,029, Shiley, et al, overcomes some of the disadvantages of earlier chemical processes. However, the yield obtained by this process upon scale-up does not make it economically attractive.

According to U.S. Pat. No. 4,888,029, which is a one-stage process, in the conditions of this patent (300°–500° C.; flowing inert gas containing 0.5–2% reaction accelerator) ethanol is dehydrogenated at the surface of pyrrhotite and/or troilite (FeS) formed from the pyrite in the coal to release atomic hydrogen which reacts with both the sulfur in the pyrrhotite and the troilite and with the organic sulfur (which is chemically bonded in the coal and very difficult to remove) to form gaseous hydrogen sulfide ($H_2S$) and acetaldehyde in accordance with the following reactions:

$$C_2H_5OH \xrightarrow[\text{Pyrrhotite, Troilite}]{\text{Heat}} CH_3CHO + 2H. \quad (1)$$

$$2H. + FeS \longrightarrow H_2S + Fe \quad (2)$$

$$4H. + R{-}S{-}R \longrightarrow H_2S + 2RH \quad (3)$$

However, reaction (2) is not thermodynamically favorable in the conditions of the method of U.S. Pat. No. 4,888,029 (400°–500° C.) and requires a very low concentration of $H_2S$ in the reaction bed (less than 300 ppm) to proceed forward. Such a low $H_2S$ concentration is not attainable in the conditions of the method of this patent. In addition, reactions (1) and (3) are not sufficiently catalytically activated.

SUMMARY OF THE INVENTION

Applicant has observed that when the above described process using an alcohol, which is preferably ethanol, or some other hydrogen producing agent, is performed in the presence of copper or a copper-containing material, desulfurization is dramatically increased.

While the use of a copper catalyst for the dehydrogenation of ethanol in reactions involving liquid and gaseous organic compounds is well known, no references have been found for the use of copper or a copper compound to dehydrogenate ethanol in the presence of solids, such as coal or other solid carbonaceous materials, to release nascent hydrogen.

In addition, applicant has observed that the copper serves as a scavenger for $H_2S$ to ensure a very low concentration of $H_2S$ in the reaction bed and to form copper sulfide ($Cu_2S$) which in turn serves as a catalyst for organic sulfur hydrodesulphurization reactions. Thus, the copper, unexpectedly, performs a triple role. It or a compound of it serves as a catalyst for the ethanol dehydrogenation process when ethanol or some other alcohol is used and at the same time the copper serves as a scavenger for $H_2S$ to ensure a low $H_2S$ concentration for the inorganic desulfurization (to shift the equilibrium of the FeS reduction reaction (2) above), and to form copper sulfide which in turn serves as a catalyst for organic sulfur hydrodesulphurization reactions. The result is to dramatically increase the removal of both inorganic and organic sulfur from the solid carbonaceous material. One way in which the copper has been used for this purpose is to have the copper or an alloy thereof be part of the materials of construction for a regenerable reactor. Such an approach to combine the acceptor and the catalytical techniques and to remove the sulfur through a regenerable reactor or a regenerable reactor lining material is previously unknown.

In addition, applicant has also found that by applying a portion of water alternately between portions of ethanol in the process leads to an even higher inorganic desulfurization.

Applicant has found also that applying portions of gaseous hydrogen in a copper reactor leads to a desulfurization degree which is attainable by hydrodesulfurization (treatment in a hydrogen atmosphere) in a stainless steel flow-through reactor only at much higher temperatures and at a high gas flow.

The temperature employed in practicing this process can vary. It has been found that a temperature below 400° C. is not economically attractive and not effective. Temperatures up to 1000° C. can be employed, but the method is effective even in a lower temperature range of 400°–600° C.

It is therefore an object of this invention to remove a significantly large amount of the sulfur contained in a solid carbonaceous material, such as coal, petroleum coke and charcoal, either as pyrites or as organically bound sulfur.

It is a further object of this invention to accomplish the sulfur removal using relatively low temperatures.

It is a further object of this invention to accomplish this in the presence of copper.

These, together with other objects and advantages of the invention will become more readily apparent to those skilled in the art when the following general statements and descriptions are read in light of the appended drawing.

DETAILED DESCRIPTION OF THE INVENTION

Figure 1:
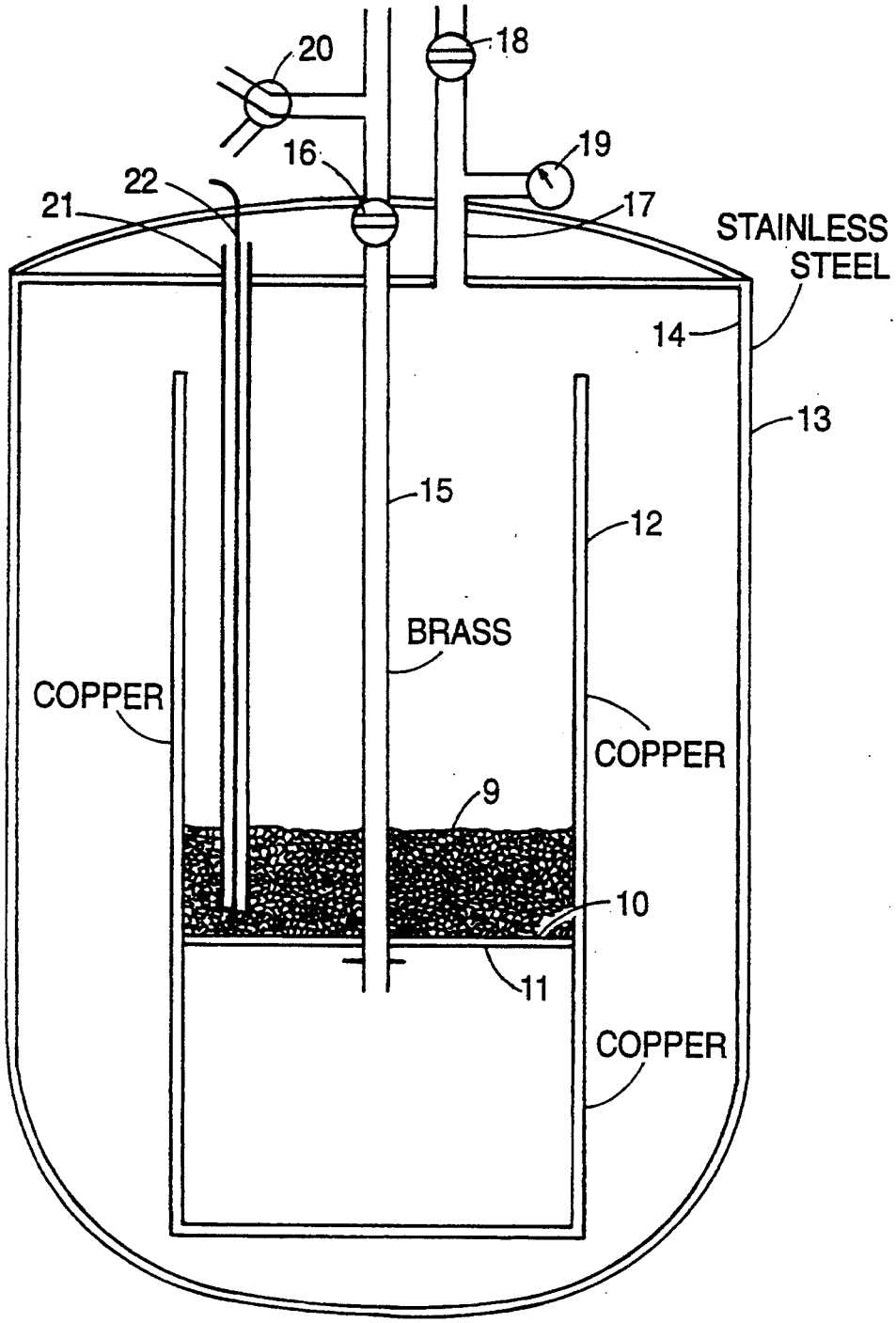
FIG. 1 is a side elevation view of the experimental equipment used in generating the data for the examples set forth in the Detailed Description of the Invention.

The method of the invention is described in the following examples in which the solid carbonaceous material treated is coal. The examples vary in the manner in which the coal is treated so as to show the advantages of the method constituting the instant invention.

LABORATORY SET-UP FOR EXAMPLES

Referring to FIG. 1, five to ten grams of coal 9 were placed on fine copper screen 10 supported by perforated plate 11 in copper reactor 12. Copper reactor 12 is fixed to stainless steel autoclave 13 at the upper portion 14 of autoclave 13 by means of the brass tube 15. The brass tube 15 also permits the inflow of inert gas and reactants into the copper reactor 12. The brass tube 15 is provided with a valve 16. An exit pipe 17 is provided with a valve 18 and a pressure gauge 19. Brass tube 15 is also provided with a two-way valve 20 which permits the introduction of ethanol or water as desired. A copper tube 21 is provided for a temperature probe 22. The stainless steel autoclave 13 was inserted into an electric furnace. Inert gas was introduced through the brass tube 15 at 50 psig. Nitrogen or helium containing 0.5% NO was used. During the experiment involving heating to a given temperature and holding it at that given temperature a constant flow of 60–80 mL/min of the inert gas was driven through the reactor system using a gas pump (not shown). An amount of ethanol, or water as the case may be, was warmed up to the boiling temperature of water and was introduced through valve 20 in the inert gas line 15 immediately before the autoclave head 14. The ethanol or water was pumped at room temperature with a liquid capacity in the range of 0.4–1 Ml/min and led through a preheater before being forced into the inert gas line. The ethanol or water was introduced in portions of 0.5 mL/g of coal. The first portion was fed immediately after reaching the desired temperature. During the introduction of reactant the inert gas flow was reduced to about 10–30 Ml/min. The treatment time intervals after each portion (when the pressure reverts to its controlled level) were selected with a view to ensure a total reaction time of 120 min at a given temperature in each experiment. For example, in a typical experiment with five grams of coal, three portions of 2.5 Ml liquid ethanol were introduced at a rate of 0.5 Ml/min (five min for the introduction of each portion) and with 35 min treatment time after each portion.

The experiments were carried out at temperatures in the range of 400°–600° C. During the experiments with a copper reactor no $H_2S$ was present in the vent flow 17 (the reaction of CdS formation in an absorber with cadmium acetate was used for detection).

0.5% NO in the helium inert gas flow was used as a radical process accelerator. This initiator has been used for desulfurization in the presence of atomic hydrogen. Other radical reaction activators besides NO may be used. For example $O_2$ is effective as a radical reaction activator.

For the regeneration of the copper reactor successive treatments (blowing through) with air (80 mL/min) at 500° C. to 700° C. and with hydrogen (30 mL/min) at 200° C. were applied. The bulk of the sulfur, retained in the sulfide layer, was burned off for 30 minutes but the roasting continued until below 20 ppm $SO_2$ was present in the air stream (about two hours). During the following reduction with hydrogen, an additional amount of $SO_2$ was produced. A two hour reduction time was usually employed. After regeneration the reactor was dismantled and cleaned by means of an air jet. During the first run after a regeneration the reactor was sulfided. The reactor retained practically a constant effectiveness in the next four runs.

Results of experiments performed in the narrow temperature range of 450°–500° C. and illustrating some effects of the reactor and the reactants are set forth in succeeding examples. The percentage desulfurization was calculated considering the weight loss of the sample. The latter varied, depending on the coal and the conditions, between 21% and 34%.

Two Ohio high-volatile bituminous coals were used in these experiments. They were a sample of Ohio #6 (Middle Kittaning) coal obtained from the Penn State Coal Bank (PSOC-1518) and a sample of washed Ohio #4A coal, collected from the Sands Hill Coal Company. The sulfur analysis data on the coal samples used were as follows: Coal Total Sulfur Pyritic Sulfur

| | Percent, Dry Basis | | |
|---|---|---|---|
| Coal | Total Sulfur | Pyritic Sulfur | Sulfate Sulfur |
| PSOC-1518 | 3.7 | 0.9 | 1.1* |
| Ohio #4A | 4.0 | 2.0 | 0.0 |

*This sulfate sulfur content indicates some oxidation of the sample.

EXAMPLE 1

In this case, the coal used was PSOC-1518, −100 mesh, the temperature was 450° C. and the reactor was stainless steel. No copper was present. The gas flow was nitrogen and there was no separate reactant. The percentage of sulfur in the starting coal was 3.61% and the percentage of sulfur in the finished product was 2.73%. The total desulfurization was 41.3% and this amounted to 47.7% inorganic and 31.2% organic. The reducing agents in this case were only the hydrogen and reductive hydrocarbons produced from the coal. This same example was carried on using a glass reactor rather than a stainless steel reactor and practically the same results were obtained.

EXAMPLE 2

The same coal and temperature as used in Example 1 was employed and the reactor was the same stainless steel reactor. The gas flow was helium plus 0.5% NO and there were three portions of ethanol added. The percent sulfur in the coal at the start was 3.57%, the percent sulfur in the product was 2.39% and the percent desulfurization was 47.3% total, 44.2% inorganic and 51.4% organic. From this it may be concluded that the treatment with ethanol in a stainless steel reactor affects only the organic desulfurization. The coal pyrolysis is accelerated in the presence of atomic hydrogen and the radical reaction activator NO and the organic sulfur group hydrogenolysis is enhanced (ferrous sulfide formed as well as iron oxides and aluminosilicates from the coal mineral matter can serve as catalysts). The presence of atomic hydrogen when ethanol is applied does not affect the reduction of $FeS_2$ and FeS.

EXAMPLE 3

The same coal as used in the previous two examples was employed, the temperature was 460° C. The reactor however was copper sulfided and the gas flow and ethanol proportions were used as in Example 2. The initial sulfur in the coal was 3.83% and the sulfur in the product was 1.27%. The percent desulfurization was as follows: 75.1% total, the inorganic being 80.6% and the organic 68.1%. From this it can be concluded that the use of a copper reactor strongly affects the inorganic desulfurization by the effect on the equilibrium of the FeS reduction. It also may be concluded that ethanol is more effective for the organic desulfurization in a copper reactor than in a stainless steel reactor. That is explained by better catalytic conditions for ethanol dehydrogenation and/or by the catalytic influence of a copper sulfide covering rather than by a copper scavenger effect.

EXAMPLE 4

This shows the effect of a copper reactor without ethanol treatment. Ohio 4A, −20 mesh coal was employed. The temperature was 480°, the reactor was copper, sulfided, the same gas as used in Examples 2 and 3 was employed but there was no reactant, i.e. no ethanol. The percent sulfur in the coal was 3.97%, the percent sulfur in the product was 3.08%, the total percent desulfurization was 46.3% and this involved 65.3% inorganic and 27.9% organic. This shows that the quick removal of $H_2S$ on the reactor walls does not affect the organic desulfurization. This indicates that the organic sulfur group hydrogenolysis is determined by the kinetics of the reactions and their catalysis rather than by their thermodynamic equilibrium.

EXAMPLE 5

The same temperature and reactor were used as in Example 4. Ohio No. 4A coal, −100 mesh was used. There were three portions of ethanol used as a reactant. The percent sulfur in the coal was 3.72%, the percent sulfur in the product was 1.56%, the percent desulfurization was 69.6% consisting of 69.9% inorganic and 69.4% organic. It appears that the PSOC-1518 coal sample containing a total of 2% pyritic and sulfate sulfur is easier to desulfate than Ohio No. 4A coal containing only 2% pyritic sulfur. Compare Examples 3 and 5.

EXAMPLE 6

In this case Ohio #4A, −100 mesh coal, a temperature of 500° C., the same reactor, and the same gas flow were used as in Example 7. However, two portions of ethanol and one portion of water were used. The percent sulfur starting in the coal was 3.80%, the percent sulfur in the product was 0.98%, the percent desulfurization was 82.7% consisting of 93.2% inorganic and 72.6% organic. Thus it will be seen that applying a portion of water between two portions of ethanol leads to an even higher pyritic desulfurization. That is explained by a shift of the equilibrium of the reaction of iron sulfide.

EXAMPLE 7

In this case the same coal, reaction temperature, type of reactor, gas flow and reactants were used as in Example 6, the percentage of sulfur in the starting coal was 3.80%, the percentage of sulfur in the product was 0.55%, and the percentage of desulfurization was 90.4%. The conditions were changed from the previous examples, however, in the following: Before the introduction of each portion of reactant the gas flow rate was reduced to 5–10 mL/min and maintained at this low level during the entire reaction (residence) time of the respective reactant. In this way, keeping the same total holding time (120 min) at a given temperature, the residence time of the reactants used was increased. In practice, in the three portion experiments with 5 g coal and reactant portions of 2.5 Ml (0.5 mL/g coal), each reactant was introduced for five minutes (0.5 mL/min) and allowed to react for 25 minutes at a reduced gas flow rate of 5–10 mL/min. A higher gas flow rate of 80–150 mL/min was maintained only during two intervals of 15 minutes between the portions when the pressure reverted to its initial level (50 psig).

This shows the positive effect of the increased residence time of the reactants on the degree of desulfurization.

EXAMPLE 8

The coal, temperature, reactor and gas flow were the same as in the previous example. Portions were changed to 1 ml per gram of coal. Only two portions were used: One portion of water followed by one portion of ethanol. In the case of two portion experiments with 5 grams of coal, the conditions with respect to the residence time of the reactants were changed as follows: Portions of 5 mL (1 mL/g coal) of each reactant were introduced for five minutes (1 mL/min) and allowed to react for 45 minutes at a reduced gas flow rate of 5–10 mL/min. During an interval of 20 minutes between the portions a higher gas flow rate of 80–150 mL/min was maintained when the pressure reverted to its initial level of 50 psig after having increased to >200 psig during the addition of reactants.

The percentage of sulfur in the coal was 3.86%, the percentage of sulfur in the product was 0.71%, and the total desulfurization was 87.95%. The conclusion that may be drawn from this example is that one can use a single addition of the ethanol rather than two smaller equivalent amounts to get a similar percentage desulfurization.

EXAMPLE 9

The same conditions were employed as in the previous Example 8. However, in this example instead of applying a 5 mL (0086 mol) ethanol portion, one portion of hydrogen gas (0.1 mol) was used. The percentage of sulfur in the coal was 3.87%, percentage sulfur in the product was 1.36%, the percentage of desulfurization employed was 78.3%, the inorganic desulfurization was 88.6% and the organic desulfurization was 68.0%. The conclusion that may be drawn from this example is that an equivalent portion of ethanol is more effective than an equivalent portion of hydrogen. Obviously, hydrogen is also of interest as a reactant but is not as effective as ethanol in these conditions.

SUMMARY OF RESULTS

| Run No. | Coal | Temp. °C. | Reactor | Gas Flow | Reactant No. of Portions | % S in the coal | % S in the product | Desulfurization Total | Desulfurization Inorganic | Desulfurization Organic |
|---|---|---|---|---|---|---|---|---|---|---|
| 1 | PSOC-1518 -100 mesh | 450 | Stainless steel | Nitrogen | No reactant | 3.61 | 2.73 | 41.3 | 47.7 | 31.2 |
| 2 | PSOC-1518 -100 mesh | 450 | Stainless steel | He + 0.5% NO | Ethanol, 3 portions | 3.57 | 2.39 | 47.3 | 44.2 | 51.4 |
| 3 | PSOC-1518 | 460 | Copper, sulfided | He + 0.5% NO | Ethanol, 3 portions | 3.83 | 1.27 | 75.1 | 80.6 | 68.1 |
| 4 | Ohio #4A -20 mesh | 480 | Copper, sulfided | He + 0,5% NO | No reactant | 3.97 | 3.08 | 46.3 | 65.3 | 27.9 |
| 5 | Ohio #4A -100 mesh | 480 | Copper, sulfided | He + 0.5% NO | Ethanol, 3 portions | 3.72 | 1.56 | 69.6 | 69.9 | 69.4 |
| 6 | Ohio #4A -100 mesh | 500 | Copper, sulfided | He + 0.5% NO | Ethanol, 2 portions Water, 1 portion | 3.80 | 0.98 | 82.7 | 93.2 | 72.6 |
| 7 | Ohio #4A -100 mesh | 500 | Copper, sulfided | He + 0.5% NO | Ethanol, 2 portions* Water, 1 portion* | 3.80 | 0.55 | 90.4 | | |
| 8 | Ohio #4A -100 mesh | 500 | Copper, sulfided | He + 0.5% NO | Water, 1 portion** Ethanol, 1 portion** | 3.86 | 0.71 | 87.95 | | |
| 9 | Ohio #4A -100 mesh | 500 | Copper, sulfided | He + 0.5% NO | Water, 1 portion $H_2$ Gas 1 portion (0.1 mol) | 3.87 | 1.36 | 78.3 | 88.6 | 68.0 |

*Enhanced residence time of the reactants.
**Enhanced amount of the reactants and of their residence time.

From the above experimental results it will be seen that the inorganic and organic desulfurization of solid carbonaceous material is increased significantly using ethanol which dehydrogenates at 450°-500° C. in the presence of copper. The enhanced inorganic desulfurization is determined by the copper scavenger effect. In addition, in presence of ethanol, which dehydrogenates, or hydrogen, the organic desulfurization of carbonaceous material is improved considerably by the catalytic influence of the copper sulfide formed. When ethanol is used, one has a better catalytic dehydrogenization of the ethanol in the presence of copper.

While this invention has been described in its preferred embodiment, it is to be appreciated that variations therefrom may be made without departing from the true scope and spirit of the invention.

What is claimed:

1. A method of reducing the quantity of both inorganic and organic sulfur in a solid carbonaceous material prior to use of said solid carbonaceous material which comprises:

heating said solid carbonaceous material containing inorganic and organic sulfur in the presence of a metallic solid copper-containing material and a hydrogen-producing agent, utilizing said metallic solid copper-containing material in a surface activated condition as a catalyst for the dehydrogenation of said hydrogen-producing agent to produce in-situ produced hydrogen, reacting said in-situ produced hydrogen so produced with said inorganic and organic sulfur in said carbonaceous material to produce hydrogen sulfide, reacting said hydrogen sulfide so produced with said metallic solid copper-containing material to form copper sulfide, and utilizing said copper sulfide so produced as a catalyst for organic sulfur hydrodesulphurization reactions of said solid carbonaceous material.

2. The method of claim 1 wherein said hydrogen-producing agent is alcohol.

3. The method of claim 2 wherein said hydrogen-producing agent is ethanol.

4. The method of claim 1 wherein said solid carbonaceous material is also heated in the presence of water.

5. The method of claim 2 wherein said solid carbonaceous material is also heated in the presence of water.

6. The method of claim 3 wherein said solid carbonaceous material is also heated in the presence of water.

7. The method of claim 1 wherein said heating step involves heating above 400° C.

8. The method of claim 2 wherein said heating step involves heating above 400° C.

9. The method of claim 3 wherein said heating step involves heating above 400° C.

10. The method of claim 4 wherein said heating step involves heating above 400° C.

11. The method of claim 5 wherein said heating step involves heating above 400° C.

12. The method of claim 6 wherein said heating step involves heating above 400° C.

13. The method of claim 3 wherein said heating occurs in the presence of a radical reaction activator.

14. The method of claim 13 wherein said radical reaction activator is taken from the group consisting of NO and $O_2$.

15. The method of claim 6 wherein said heating occurs in the presence of a radical reaction activator.

16. The method of claim 15 wherein said radical reaction activator is taken from the group consisting of NO and $O_2$.

17. The method of claim 9 wherein said heating occurs in the presence of a radical reaction activator.

18. The method of claim 17 wherein said radical reaction activator is taken from the group consisting of NO and $O_2$.

* * * * *